US005240127A

United States Patent [19]

Levin et al.

[11] Patent Number: 5,240,127

[45] Date of Patent: Aug. 31, 1993

[54] MODULAR DISPLAY SYSTEM

[75] Inventors: Charles Levin, Riverdale, N.Y.; Barry Kramer, Stamford, Conn.; Roberto Gutierrez, White Plains, N.Y.

[73] Assignee: NYSCO Products, Inc., Bronx, N.Y.

[21] Appl. No.: 832,296

[22] Filed: Feb. 7, 1992

[51] Int. Cl.[5] ..... A47F 5/00

[52] U.S. Cl. ..... 211/186; 211/133

[58] Field of Search ..... 211/186, 133, 189, 188, 211/194, 187; 108/111

[56] References Cited

U.S. PATENT DOCUMENTS

| | | | |
|---|---|---|---|
| 540,435 | 6/1895 | Godfrey . | |
| 2,894,642 | 7/1959 | Clevett, Jr. et al. . | |
| 3,081,718 | 3/1963 | Shoffner . | |
| 3,700,114 | 10/1972 | Myers . | |
| 3,847,458 | 11/1974 | Nowak | 211/188 X |
| 3,921,539 | 11/1975 | Berger . | |
| 4,442,778 | 4/1984 | Lang | 211/186 X |
| 4,940,150 | 7/1990 | Spengler | 211/188 |
| 5,000,329 | 3/1991 | Luberto | 211/133 X |
| 5,094,352 | 3/1992 | Green, Sr. et al. | 211/186 |

*Primary Examiner*—Alvin C. Chin-Shue
*Assistant Examiner*—Sarah Lechok
*Attorney, Agent, or Firm*—Kenyon & Kenyon

[57] ABSTRACT

A modular display unit employing a pair of spaced apart feet having prongs that engage a transverse beam or shelf unit. The display unit is composed of a series of shelves, beams, side portions and feet, which can be combined to provide units of varying widths and heights. The shelves are centrally supported in their depth dimension from a pair of laterally disposed side portions.

21 Claims, 9 Drawing Sheets

MODULAR DISPLAY SYSTEM

BACKGROUND OF THE INVENTION

The invention relates generally to a display system and, more particularly, to a shelf display system of modular construction.

In modern point of sales displays, merchants desire the ability to display their merchandise in an attractive and economical manner. The manufacturers of the goods sold by merchants often provide merchants with temporary display fixtures for the display of their particular merchandise. Such temporary displays must be space efficient, inexpensive, and easy to use.

Display systems employing shelves suspended from four corner posts have been known. While effective for use in storing goods and providing stability, such four corner post systems are deficient from the stand point of the marketer, in that the presence of four corner posts impedes customer access to the product.

Shelf units have been built in which the shelves are suspended from a pair of laterally spaced side posts instead of four corner posts, thereby providing consumers with greater access to the product. U.S. Pat. No. 3,081,718 to Shoffner shows one common manner of eliminating corner posts by suspending shelves in cantilever fashion from a central supporting portion. U.S. Pat. No. 3,921,539 to Bergen shows shelves supported at their sides by a pair of standards 13. While these and other shelving systems can be used to display products, they typically either lack modularity (i.e., the ability to quickly alter the size of the display), are expensive to manufacture, or require an excessive amount of time and skill to erect. There remains a need for an economical display system utilizing only two vertical support posts that offers the merchant a high degree of versatility and marketing efficacy In addition to providing an attractive means of displaying a product, it is also desirable that such a display system can be easily assembled with a minimum amount of labor. Ideally, assembly should be so mechanically simple that the display can be assembled by hand without tools.

SUMMARY OF THE INVENTION

This invention meets these needs in that it provides a display system in which a series of shelves are supported by modular side posts, one on each side of the shelves and centered along the depth dimension of each shelf. The side posts extend only the desired spacing between shelves, and provide for a mechanically sound interlock with the shelves. The invention further utilizes a pair of struts at the upper and lower portions of the display unit to tie together the left and right hand sides to provide further stability. These struts are also configured to mechanically interlock with the side posts by merely pressing the latter into the appropriate portions of the former. The struts may be in the form of shelves or merely as space beams for linking the sides of the display together. The display is supported on a pair of laterally spaced apart feet that interlock with the shelves or space beams and which serve to elevate the lower-most portion of the display an appropriate distance above the surrounding floor.

By employing a modular design in which shelves, space beams, support feet, and side posts are provided as modular elements that can be connected by hand in a simple and intuitive manner, the display system provides the merchant with an economical and versatile means of displaying his products. The use of centrally supported shelves attached to broadly based support feet by means of side posts results in excellent load distribution and stability, as well as wide product access. A further feature of the invention is the use of spacer elements extending transversely with and defining slots with respect to the space beam struts that are employed to tie together the left and right hand halves of the display unit. The slots defined by the spacers enable the struts to accommodate posters, particle boards having holes, and other display material.

DETAILED DESCRIPTION OF PREFERRED EMBODIMENT

Figure 3A:
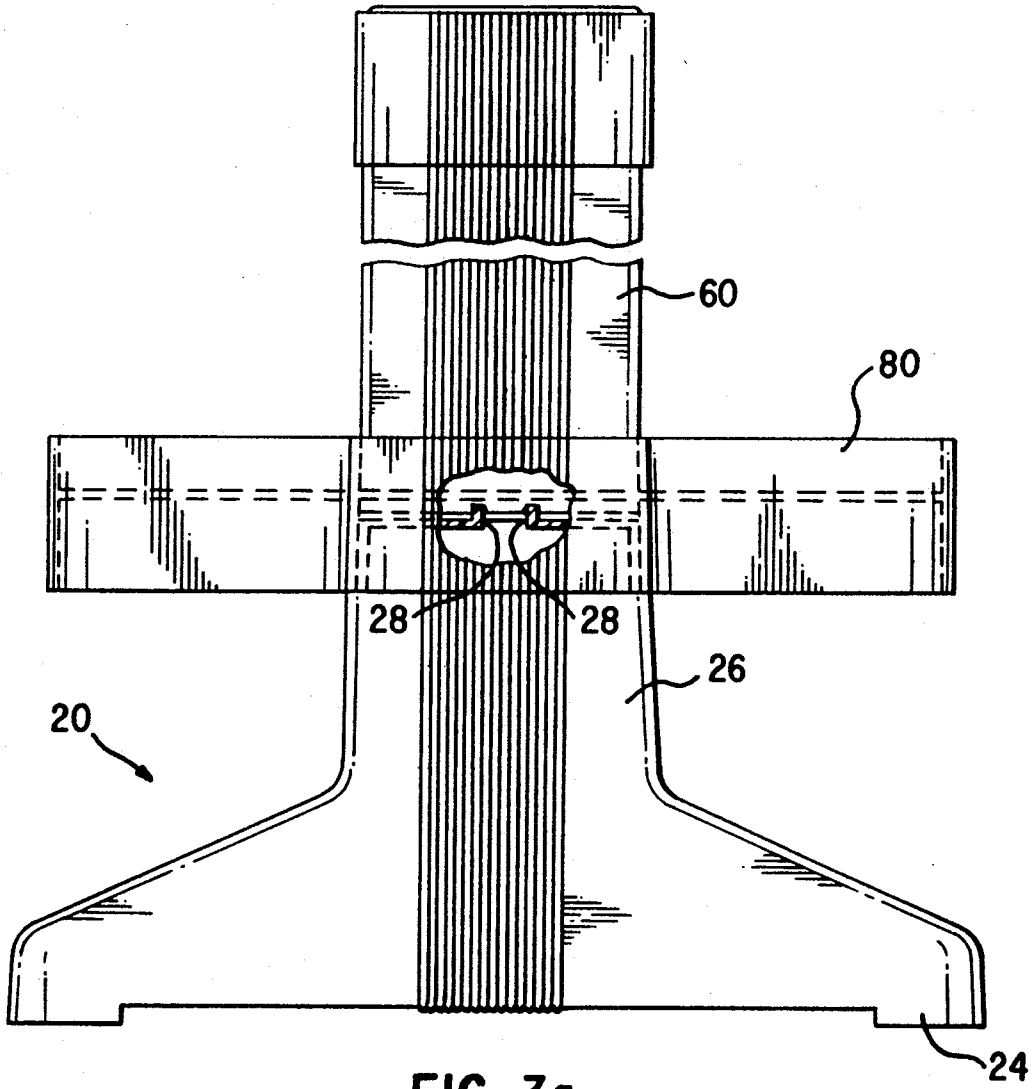
FIG. 3*a* is a side plan view partially in section of a foot portion, shelf, and side post in cooperative engagement.
Figure 3B:
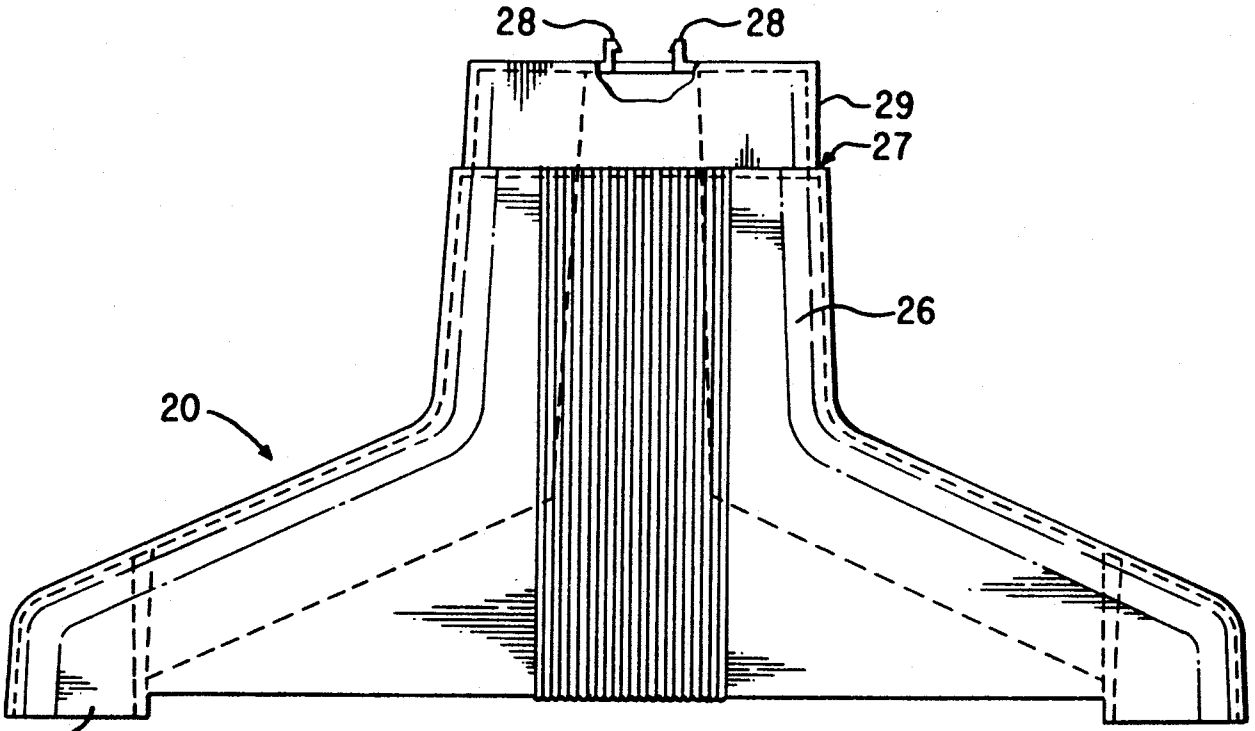
FIG. 3*b* is a side plan view of the foot portion alone.
Figure 3C:
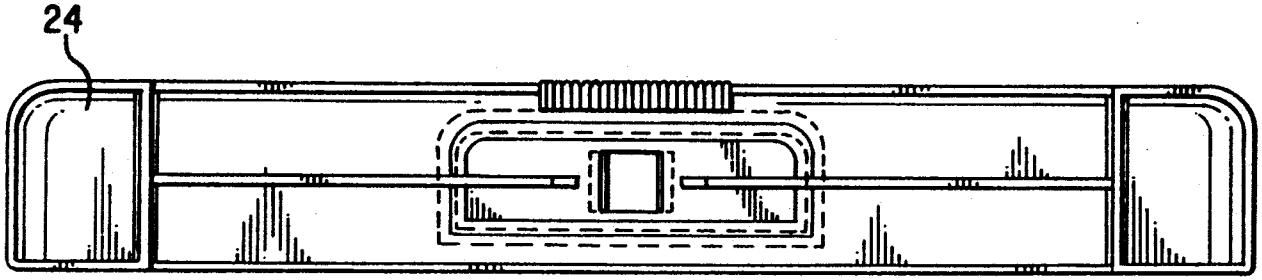
FIG. 3*c* is a bottom plan view of the foot portion shown in FIG. 3*b*.

The display system shall now be described with reference to the figures. The display system rests on a pair of spaced apart foot portions 20 (see FIGS. 3*a*-3*c*). Each foot portion may be provided at its lower end with a pair of spaced apart, downwardly extending hollow projections 24 that raise the remainder of the foot portions above the floor (e.g. 0.25 inches above the floor). Casters or plugs may be provided for insertion into these projections to facilitate the transport or height adjustment of the display system. The foot portion tapers upwardly, first via a first pedestal portion 26, and then via a set-off second pedestal portion 29 that defines a ledge 27 with respect to the first pedestal portion 26 (see FIG. 3*b*). This ledge 27 provides a support surface for either the shelf or space beam to which it may be connected. The second pedestal portion terminates in a pair of closely spaced apart, inwardly directed prongs 28 (see FIG. 3*b*). These prongs are configured to provide mechanical interlock with a web portion of the space beam or shelf as shall be explained below.

Figure 4:
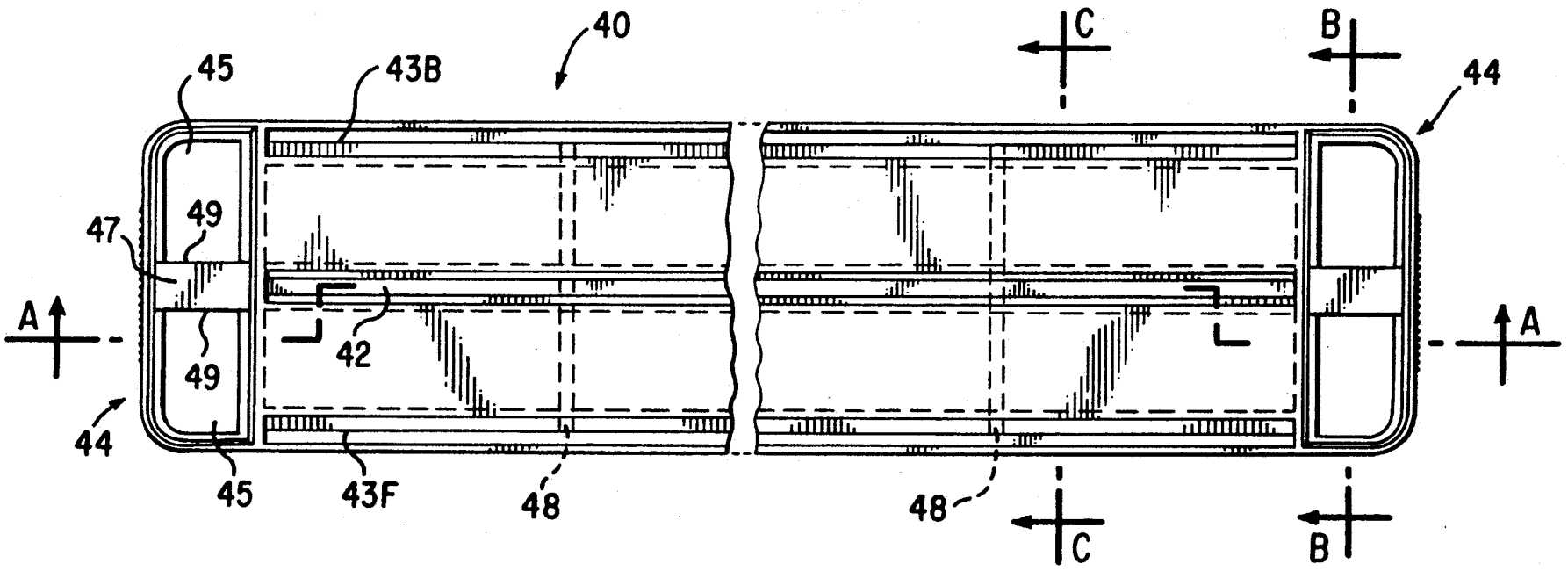
FIG. 4 is a top plan view of a space beam.
Figure 5:
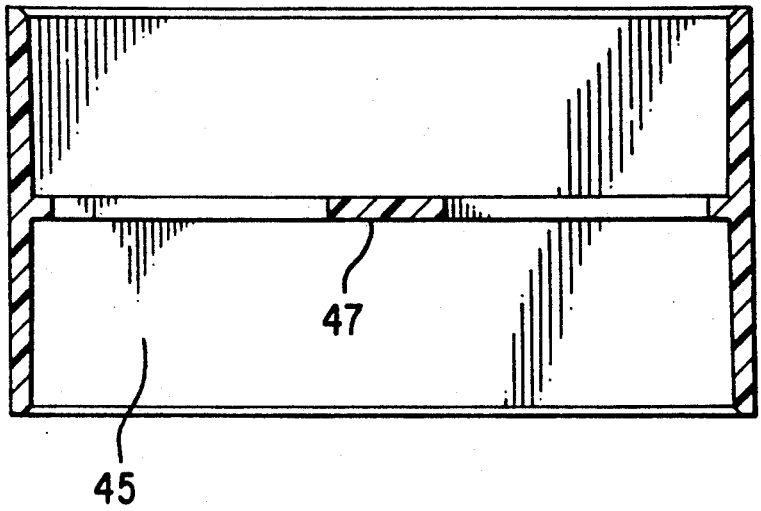
FIG. 5 is a view of the space beam taken along line B—B of FIG. 4.
Figure 6:
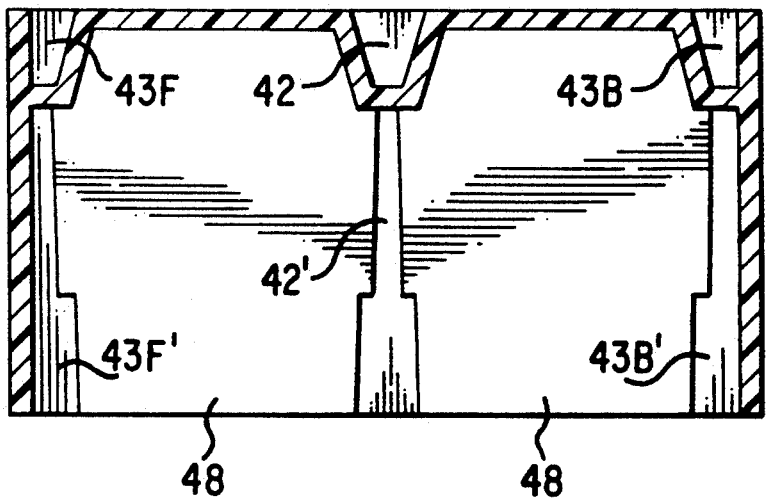
FIG. 6/is a sectional view of the space beam taken along line C—C of FIG. 4 showing slot-defining spacer structure.
Figure 7:
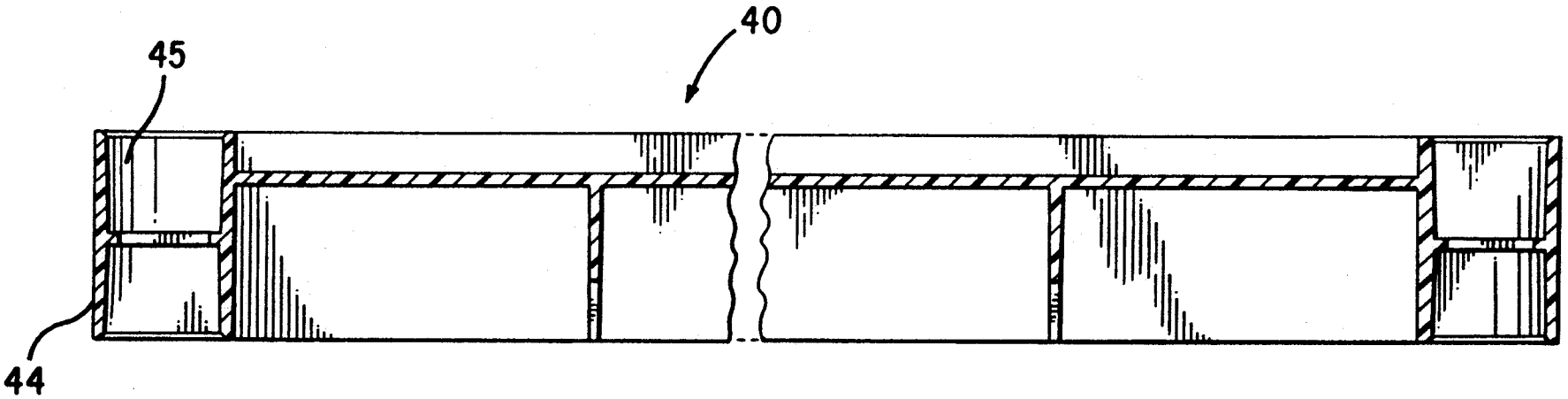
FIG. 7 is a longitudinal sectional view taken along line A—A of the space beam of FIG. 4.

The laterally spaced foot portions may be tied together by a space beam 40 which acts as a linking strut. As seen in FIGS. 4–6, the space beam may be manufactured as a molded plastic strut which terminates at either end in a wing-like portion 44 defining a generally open recess or socket 45. A relatively thin web 47 located intermediate the upper and lower surfaces of the space beam (see FIG. 5) provides a surface against which the prongs of the foot portion may be brought into cooperative interlocking engagement. Consequently, the width of the web 47 is approximately the same as the spacing of the interlocking prongs. Recessed sockets 45 cooperate with the remainder of the ledge and pedestal portions of the foot portion 20 to provide a further mechanical interlock in the portion of the sockets beneath web 47. The sockets also are configured to mate with side posts 60 as shall be explained below.

The space beam is further provided with at least two pairs of spacers 48 that extend transversely with respect to the beam (see FIGS. 4 and 6). These spacers 48 are spaced both from each other and the front and back portions of the space beam to define therebetween three slots (43'F, 43'B, and 42') at two transverse sections located along the lower surface of the beam. Three longitudinally extending slots, extending along the length of the beam (front and back slots 43F and 43B, and center slot 42), are located on the upper portion of the space beam. The presence of these slots in the space beam enables the space beam to accommodate and restrain the longitudinally extending bottom edge (by cooperation with slots 42, 43F, or 43B) or top edge (by cooperation with slots 43'F, 43'B, or 42') of an advertising display board or a particle board with holes. The lower edge of the board can be nested in any of the three slots running along the center or edges of the top of the space beam. A second space beam of identical width is used to provide, via the slots provided by the spacers 48, recesses for mechanical engagement with the top portions of the boards.

Shelving units 80 are spaced from one another and from the space beam by side posts 60, which may be formed of extruded polyvinylchloride or other suitable polymer. The side posts are configured in cross section to mate and frictionally interlock with the sockets 45 located at the wing portions 44 of the space beam, or with similarly configured sockets 85 located along the wing portions 84 of the shelf units. Thus, the side posts are seen to provide vertical spacing between levels of the display system by engagement with either the space beam or shelf elements. The side posts are formed by extrusion, which enables one to obtain side posts of any desired length merely by cutting the extrusion. This is a far less expensive manner of providing for a range of side post lengths than molding, which requires the creation of a new mold every time a new length is desired.

Figure 8:
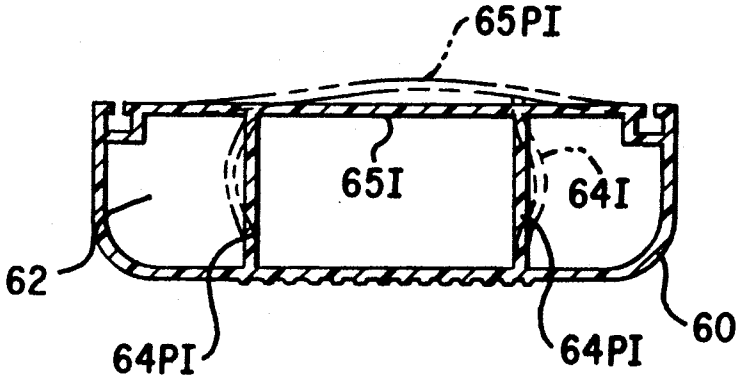
FIG. 8 is a sectional view of one of the side posts shown in FIG. 1.

A further feature of the extruded side posts is the use of webs 64 extending along the length of the side posts. The webs both add strength and help establish a firm connection between the side posts and the tapered sockets into which they are inserted. Prior to insertion, the extruded side post wall 65 may have a slight outward bulge 65PI (Prior Insertion) as shown in FIG. 8. At this point, prior to insertion, the webs 64 will be generally straight and flat along their entire length, as shown at 64PI in solid lines. Upon insertion, the outward bulge 65PI vanishes as the post is forced into conformity with the socket walls. Concomitantly with insertion, the portion of the webs 64 that are within the socket assume a slightly tapered outward bulge 64I that peaks at the extremity of the side post, through which bulge the webs 64 help to provide a spring force to assist in the frictional interlock between the web-linked walls and the socket. (It is noted that while this method for utilizing a web within a side post to enhance its mechanical interlock with a strut has been described with reference to a display system, it has applicability to the connection of mechanical elements in general.)

Figure 9:
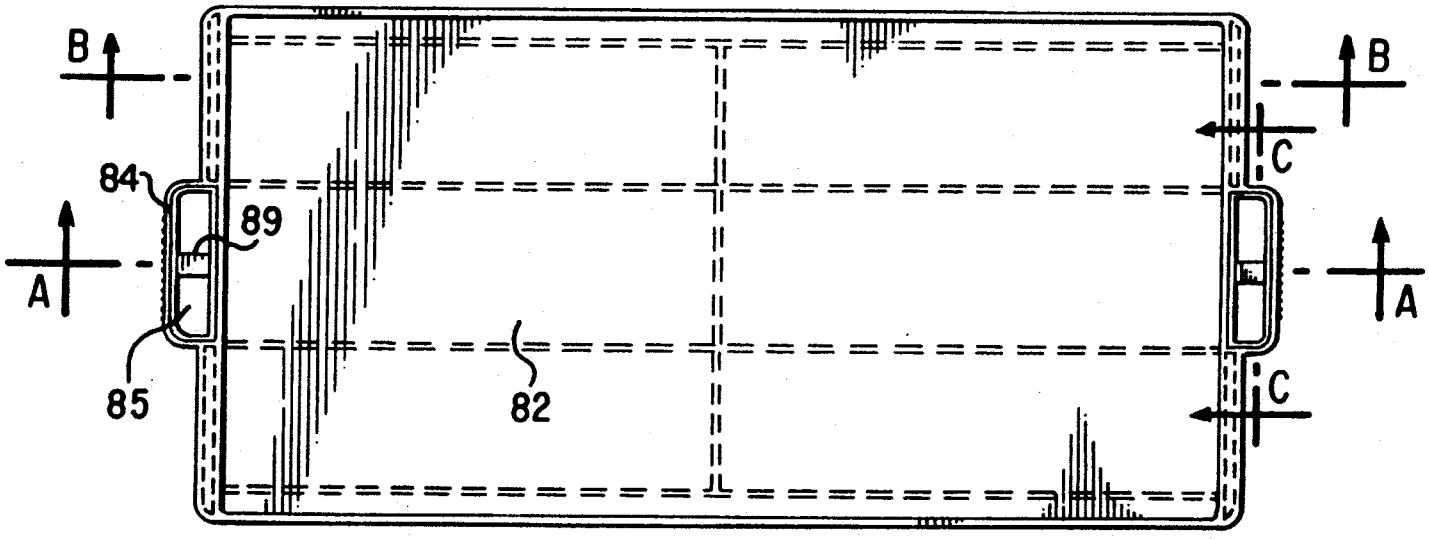
FIG. 9 is a top plan view of a shelf.
Figure 10:
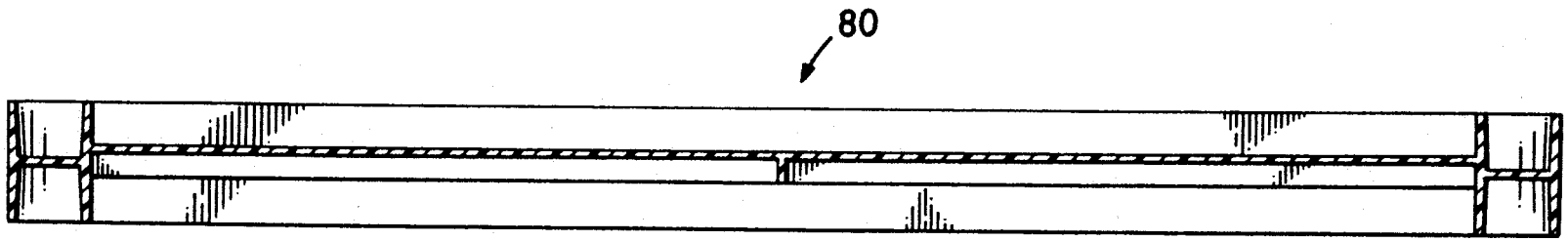
FIG. 10 is a longitudinal view taken along line A—A of FIG. 9.
Figure 11:
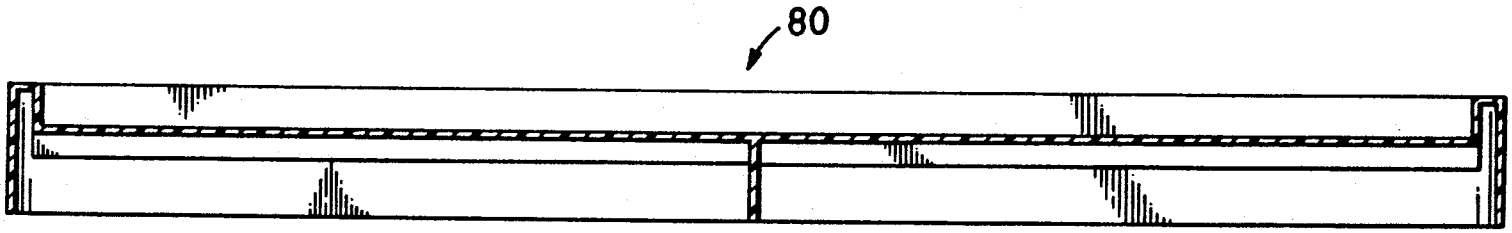
FIG. 11 is a sectional view taken along line B—B of FIG. 9.
Figure 12:
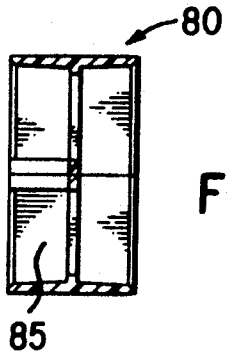
FIG. 12 is a sectional view taken along line C—C of FIG. 9.

The shelves are shown in detail in FIGS. 9–11. The shelves are molded from plastic and include wing portions 84 at each side that each contain a socket 85, similar to socket 45 of the space beam, and a web portion 89 similar to the web portion 47 of the space beam. Central portion 82 of these shelves spans the wing portions 84 and provides lateral stability in much the same functional manner as the space beam. The sockets 85 can accommodate side posts 60 from above or below the web 89. Where the shelf is used as a space beam, web 89 cooperates with the prongs 28 of the foot portion to provide snap-in mechanical interlock therewith. Otherwise, the wing portions of the shelves interlock with the side posts by way of a frictional fit between the sockets and the side posts.

The overall system is modular in nature. Depending on one's needs and space limitations, one selects an appropriately sized width for the space beams and shelves. These are typically provided in 16, 20 and 24 inches sizes, although other widths may be used. A standard set of feet (typically sized to space the first shelf or space beam 6 inches from the floor) is snapped into the sockets of either a space beam or a shelf, so that the space beam (or shelf) connects the two foot portions to one another. In either case, the foot portions will interconnect to the shelf or space beam with a frictional fit and a mechanical interlock between the web and pair of prongs. Side posts are then pressed into the upper halves of the sockets of the space beam or shelves to provide the desired spacing above this shelf for the next level, which may be a strut or a shelf. These sockets have a slight taper, in contrast to the non-tapered extruded side posts. This allows one to achieve a progressively tighter connection between socket and side post as one inserts the side post. The upper ends of these side posts are then press-fitted into the sockets of the next shelf or space beam. This process is repeated until one has obtained a display of the desired size. The structure may be topped off with a shelf or space beam. It will be appreciated that each of the connections described above is readily reversible, so that the display can be disassembled if need be. This construction does not require any hand tools and is very simple to effect, requiring only that parts be pressed into one another. By providing side posts with varying lengths and space beams and shelves in varying widths, one obtains a display system whose dimensions can readily be customized to suit the requirements of any particular product merchandiser.

Because of the open, modular nature of the design employed, additional levels of shelves can be added to an existing structure.

Figure 1:
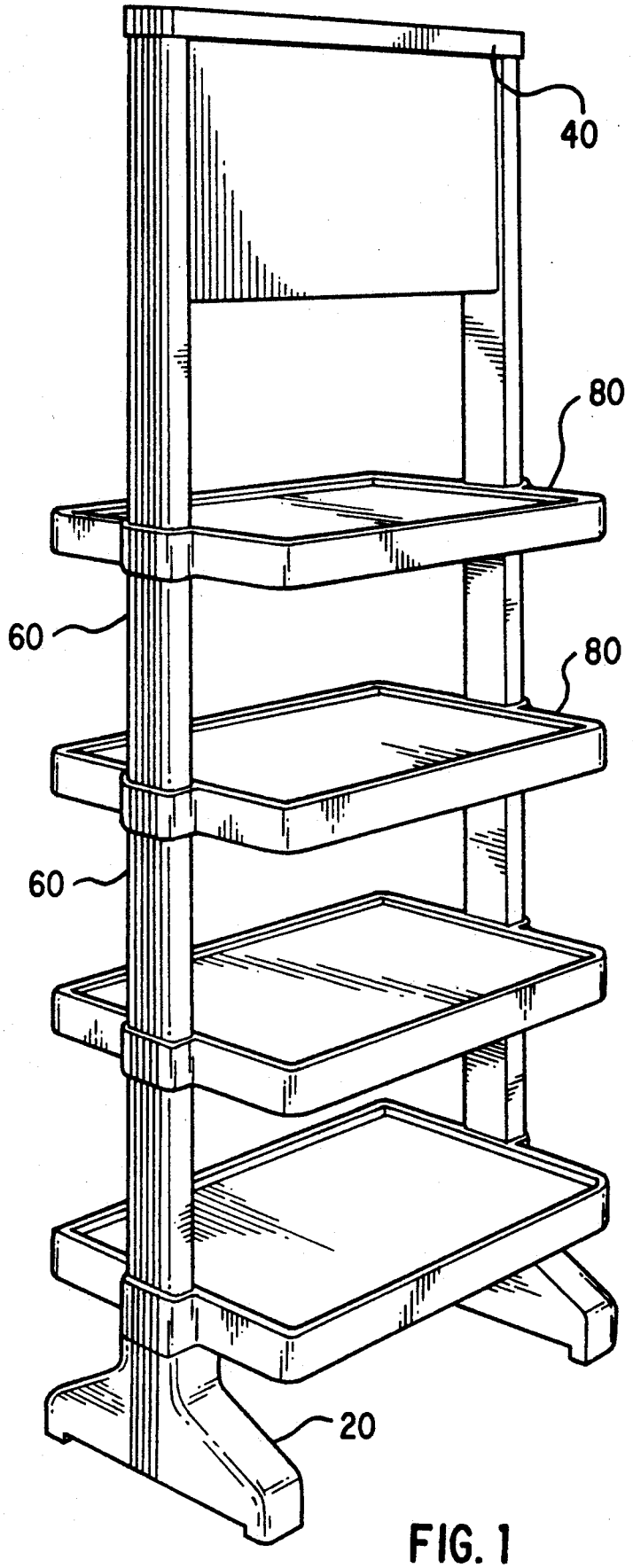
FIG. 1 is a perspective view of the display system.
Figure 2:
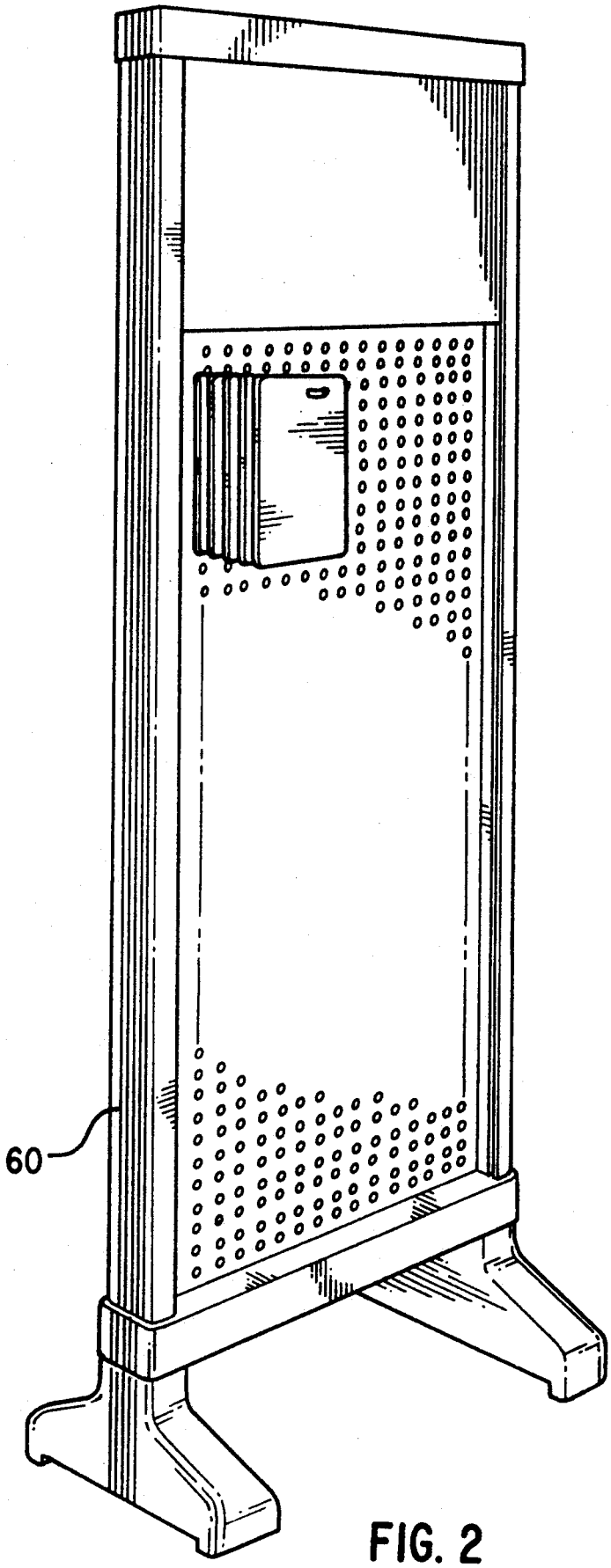
FIG. 2 is a perspective view of a second embodiment in which the display system is used to support a section of particle board with holes.

The structure also allows for accommodating display boards. By providing a set of space beams that directly face one another (see FIG. 2, in which the upper portion of the board is occluded by an overlying header), the slots provided in the top and underside of the space beams can be used to provide three positions for retaining a particle board with holes, advertising board or other display board. One may also provide a particle board with holes or other display board that has been framed by a pair of space beams along only a portion of the height of the display unit, and utilize linked side posts and shelves to provide an appropriate number of shelves above or below such a board. The sockets of the top-most shelves or space beam may be closed off with a cap, or used as a socket into which the standard pole of an advertisement banner or sign may be inserted.

What is claimed is:

1. A display system comprising:

a pair of supporting feet having a broad lower portion and tapering to a narrower, pedestal like upper portion extending above the center of the lower portion.

a pair of spaced apart vertically disected prongs located at the upper portion of each of the supporting feet;

at least two side posts;

at least two strut elements selected from the group consisting of a space beam and a shelf, said strut elements having wing portions defining means for mechanically interlocking with said supporting feet and with said side posts; and whereby the strut elements interlock with and form a lateral span with respect to the side posts to form a display system.

2. The device of claim 1, wherein the mechanical interlock means of the strut elements include a recessed portion for receiving an end portion of said strut element.

3. The device of claim 1, wherein the space beam comprises an upper surface and a lower surface; and at least one slot extending along the length of the upper surface of the space beam.

4. The device of claim 3, wherein the space beam further comprises a plurality of transverse spacers on its underside, each spacer being configured to define at least one slot-like gap, wherein the slots on the upper portion and the gaps on the lower portion of the space beam are configured to grip the opposite edge portions of a board.

5. The device of claim 1, wherein the struts include tapered recessed portions to accommodate a frictional interlock between the struts and the sideposts.

6. The device of claim 1, wherein the side posts are made of extruded plastic.

7. The device of claim 1, wherein the struts are made of molded plastic.

8. A display system comprising:

a pair of supporting feet having a broad lower portion and tapering to a narrower, pedestal like upper portion extending above the center of the lower portion;

a plurality of spaced apart vertically disected prongs located at the upper portion of each of the supporting feet;

at least two side posts;

at least two strut elements having a depth dimension, said strut elements being selected from the group consisting of a space beam and a shelf, said strut elements having wing portions at each end that are centered with respect to the depth dimension of the strut, said wing portions defining means for mechanically interlocking with said supporting feet and with said side pots; and whereby the strut elements interlock with and form a lateral span with respect to the side posts to form a display system.

9. The device of claim 8, wherein the mechanical interlock means of the strut elements include a recessed portion, and wherein said recessed portion of the strut includes a web-like portion.

10. The device of claim 8, wherein the space beam comprises an upper surface and a lower surface; and at least one slot extending along the length of the upper surface of the space beam.

11. The device of claim 10, wherein the space beam further comprises a plurality of transverse spacers on its underside, each spacer being configured to define at least one slot-like gap.

12. The device of claim 11, wherein the slots on the upper portion and the gaps on the lower portion of the space beam are configured to grip the opposite edge portions of a board.

13. The device of claim 8, wherein the struts include tapered recessed portions.

14. The device of claim 8, wherein the side posts are made of extruded plastic.

15. The device of claim 8, wherein the struts are made of molded plastic.

16. A display system comprising:

a pair of supporting feet having a broad lower portion and tapering to a narrower, pedestal like upper portion extending above the center of the lower portion;

connector means located at the upper portion of each of the supporting feet;

at least two side posts;

at least two strut elements having a depth dimension, said strut elements being selected from the group consisting of a space beam and a shelf, said strut elements further having an upper surface and an underside;

at least one slot extending along the length of the upper surface; a plurality of transverse spacers on the underside of the strut element, each spacer being configured to define at least one slot-like gap, wherein the slots on the upper surface of one strut element and the gap-defining spacers located on the underside of a second strut element are configured to grip the opposite edge portions of a board; and wing portions at each end that are centered with respect to the depth dimension of the strut, said wing portions defining means for mechanically interlocking with said supporting feet and with said side posts;

whereby the strut elements interlock with and form a lateral span with respect to the side posts to form a display system.

17. The device of claim 16, wherein the connector means located atop the supporting feet comprises a pair of spaced apart prongs.

18. The device of claim 16, wherein the mechanical interlock means of the strut elements include a recessed portion, and wherein said recessed portion of the strut element includes a web.

19. The device of claim 16, wherein the struts include tapered recessed portions.

20. The device of claim 16, wherein the side posts are made of extruded plastic.

21. The device of claim 16, wherein the struts are made of molded plastic.

* * * * *

UNITED STATES PATENT AND TRADEMARK OFFICE

CERTIFICATE OF CORRECTION

PATENT NO. : 5,240,127
DATED : August 31, 1993
INVENTOR(S) : Charles Levin, et. al.

It is certified that error appears in the above-indentified patent and that said Letters Patent is hereby corrected as shown below:

Column 2, line 27, change "6/is" to --6 is--.

Column 5, line 14, change "disected" to --directed--.

Column 5, line 56 change "disected" to --directed--.

Signed and Sealed this

Twenty-sixth Day of April, 1994

*Attest:*

*Attesting Officer*

BRUCE LEHMAN

*Commissioner of Patents and Trademarks*